US011506461B1

(12) United States Patent
Strom et al.

(10) Patent No.: US 11,506,461 B1
(45) Date of Patent: Nov. 22, 2022

(54) QUICK CHANGE MAGAZINE COUPLER

(71) Applicant: XTech Tactical, LLC, Tempe, AZ (US)

(72) Inventors: Leif Strom, Scottsdale, AZ (US); David Spykerman, Chandler, AZ (US); Jeremy Deadman, Chandler, AZ (US)

(73) Assignee: XTECH TACTICAL, LLC, Tempe, AZ (US)

( * ) Notice: Subject to any disclaimer, the term of this patent is extended or adjusted under 35 U.S.C. 154(b) by 0 days.

(21) Appl. No.: 17/364,428

(22) Filed: Jun. 30, 2021

(51) Int. Cl.
*F41A 9/63* (2006.01)
*F41A 9/70* (2006.01)

(52) U.S. Cl.
CPC . *F41A 9/63* (2013.01); *F41A 9/70* (2013.01)

(58) Field of Classification Search
CPC ..... F41A 9/63; F41A 9/68
USPC ..... 42/49.01, 90
See application file for complete search history.

(56) References Cited

U.S. PATENT DOCUMENTS

| | | | |
|---|---|---|---|
| 3,623,256 | A | 11/1971 | Shiplee, III |
| 4,447,976 | A | 5/1984 | Cooper |
| 4,484,403 | A | 11/1984 | Schwaler |
| 4,685,238 | A | 8/1987 | Schoepflin |
| 8,887,428 | B1 | 11/2014 | Lemoine |
| 9,354,006 | B2 | 5/2016 | Purkiss |
| 9,772,151 | B1 | 9/2017 | Sanderson et al. |
| 10,323,893 | B2 | 6/2019 | Ramos |
| 10,345,063 | B1 | 7/2019 | Taylor |
| 10,365,055 | B1 | 7/2019 | Cross |
| 2011/0113668 | A1 | 5/2011 | Pestana |
| 2012/0137564 | A1 | 6/2012 | Swenson, III et al. |
| 2016/0033220 | A1 | 2/2016 | Grandy |
| 2017/0030668 | A1 | 2/2017 | Klein et al. |

FOREIGN PATENT DOCUMENTS

| | | | | |
|---|---|---|---|---|
| CA | 2945224 | A1 | 4/2018 | |
| CA | 3018250 | C | 6/2019 | |
| DE | 202020001402 | U1 | 5/2020 | |
| DE | 202020003393 | U1 * | 10/2020 | ..... F41A 9/63 |
| EP | 3236192 | A1 * | 10/2017 | ..... F41A 9/63 |

* cited by examiner

*Primary Examiner* — Reginald S Tillman, Jr.
(74) *Attorney, Agent, or Firm* — Klintworth & Rozenblat IP LLP

(57) ABSTRACT

Embodiments of a magazine coupler include a coupler body, a first magazine attachment interface coupled to the coupler body and configured to removably mount a lower end portion of the first firearm magazine to the coupler body, a second magazine attachment interface coupled to the coupler body and configured to removably mount a lower end portion of the second firearm magazine to the coupler body, and a finger aperture extending formed through the coupler body. The finger aperture is sized and shaped to enable a user or firearm operator to spin the magazine coupler about a finger of the user when inserted through the finger aperture to vary which of the first firearm magazine and the second firearm magazine resides in an upright orientation for insertion into a well of a firearm when the magazine coupler resides in a deployed state.

20 Claims, 9 Drawing Sheets

QUICK CHANGE MAGAZINE COUPLER

TECHNICAL FIELD

The following disclosure relates to firearm magazine couplers having unique structural features, which facilitate the rapid interchange of coupled magazines and provide other benefits.

BACKGROUND

Magazine couplers are mechanical devices for attaching two or more firearm magazines, often while permitting the insertion of a selected magazine into the well of a firearm. A magazine coupler ideally facilitates rapid interchange of firearm magazines in a manner enabling a user (the firearm operator) to quickly withdraw a first, recently-emptied firearm magazine from the magazine well of a firearm; and subsequently manipulate the magazine coupler to insert a second, fully-loaded firearm magazine into the magazine well in a relatively fluid or seamless manner. Existing magazine couplers often possess fairly simple, rugged designs, which retain two firearm magazines in a side-by-side relationship. For example, in one common design, a magazine coupler includes two C-shaped sections positioned in a back-to-back arrangement, with each C-shaped section dimensioned to extend partially around the body of a firearm magazine when inserted into the coupler. Additional features may also be provided to help securely retain the coupled magazines in their desired positions utilizing, for example, a resilient spring force or a clamp mechanism. Alternative magazine coupler designs have also been proposed and occasionally implemented on a commercial scale, but generally tend to be more fanciful than practical in actual usage scenarios. For example, certain magazine couplers allow the physical attachment of three or more firearm magazines in a spoke-like arrangement, which radiates from a central attachment hub; however, magazine couplers of this type tend to be relatively cumbersome, heavy, and ultimately possess limited real-world utility.

BRIEF DESCRIPTION OF THE DRAWINGS

At least one example of the present invention will hereinafter be described in conjunction with the following figures, wherein like numerals denote like elements, and.

Figure 1:
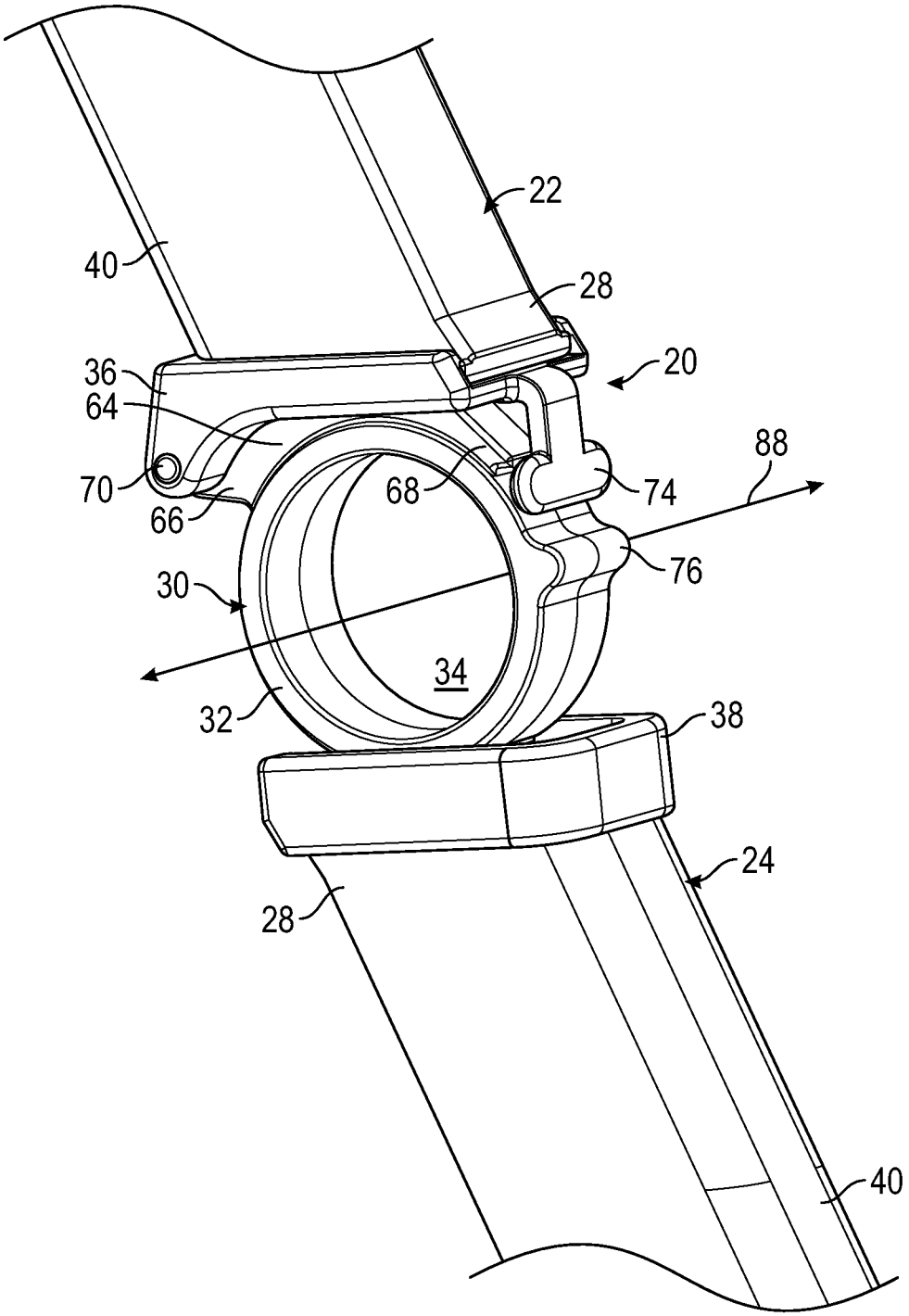
FIG. 1 is an isometric view of a quick change magazine coupler, which is utilized to secure two firearm magazines in an inverted, clocked relationship when the magazine coupler resides in a deployed (active usage) state, as illustrated in accordance with an example embodiment of the present disclosure.

For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

The following Detailed Description is merely example in nature and is not intended to limit the invention or the application and uses of the invention. Furthermore, there is no intention to be bound by any theory presented in the preceding Background or the following Detailed Description. As appearing herein, the term "finger aperture" refers to an opening formed in the below-described quick change magazine coupler and through which a user or firearm operator may insert any number of fingers, potentially including the user's thumb.

Overview

As previously noted, conventional magazine couplers often possess fairly simple designs, which may be relatively cumbersome and unwieldy in actual use scenarios in which a user (a firearm operator) attempts to quickly interchange two firearm magazines joined via the magazine coupler. Under such use case scenarios, the user attempting to interchange two magazines joined by the magazine coupler (herein, the "coupled magazines") is commonly required to manipulate the magazine coupler with a single hand, while securely holding a firearm with the user's other hand. Existing magazine coupler designs are, however, often difficult or awkward to manipulate utilizing a single hand, particularly when a user attempts interchange two magazines in relatively rapid manner and under situationally-adverse conditions of the type warranting potential firearm usage. Such situationally-adverse conditions may, for example, render it undesirable or impractical for the user to avert attention away from the surrounding environment to maintain prolonged visual contact with the magazine coupler when attempting to manipulate the magazine coupler and quickly interchange the coupled magazines. Such challenges are exacerbated by conventional coupler designs, which are often unwieldy in various respects and may require user wrist-hand motions that are awkward to perform as the user attempts to withdraw a recently-emptied firearm magazine from the magazine well of a given firearm; manipulate the magazine coupler to bring a second, fully-loaded firearm magazine into an appropriate orientation for insertion to the magazine well; and firmly insert the second firearm magazine into the magazine well to again ready the firearm for discharge.

An ongoing industrial demands thus exists for magazine couplers capable of overcoming the above-described technical challenges related to operator ease-of-use and overall utility in rapidly interchanging coupled magazines. More specifically, there exists an ongoing demand for a "quick change" magazine coupler enabling a user to rapidly interchange coupled firearm magazines in a relatively seamless, intuitive manner through natural, ergonomic motions easily performed utilizing a single hand. Ideally, embodiments of such a quick change magazine coupler would be well-suited for usage across essentially all use case scenarios, including in situationally-adverse scenarios in which sustained visual contact with the magazine coupler is impractical. It is also desirable for embodiments of such a quick change magazine coupler to securely affix the coupled firearm magazines to the body of the magazine coupler in a structurally-robust or secure manner to prevent inadvertent magazine detachment should, for example, impact or shock forces be imparted to the magazine coupler or to the coupled magazines during firearm usage. Finally, it is desirable for such a quick change magazine coupler to be amenable to straightforward, cost-effective manufacture; and, in at least some instances, to facilitate compact, non-use storage of the magazine coupler and the firearm magazines joined thereby.

In satisfaction of the above-described industrial demand, the following discloses a quick change magazine coupler including at least first and second magazine attachment interfaces, which are joined through a central coupler body. The first and second magazine attachment interfaces (alternatively referred to as "magazine mounts") are each structurally configured to removably mount a lower end portion of a firearm magazine to the coupler body. The magazine attachment interfaces may assume various structural forms suitable for performing this function. The magazine attachment interfaces may each include any combination of resilient features, clamp mechanisms, set screws, cinches or ties, and other such structural features, which are adapted to secure the lower end portion of a firearm magazine to the coupler body. In certain implementations, the magazine attachment interfaces each include or assume the form of a slotted adapter piece, which is structurally configured (sized and shaped) to matingly receive the lower end of a firearm magazine after removal of an existing baseplate therefrom. In such implementations, the slotted adapter pieces may each be configured to slide into a mating relationship (close-fit engagement) with a lower end portion of a firearm magazine following removal of the original equipment manufacturer (OEM) baseplate or other existing baseplate. For example, in embodiments, the slotted adapter pieces may insert onto outwardly-projecting flanges, which extend from opposing edges of a lower portion of the tubular firearm body and which are typically engaged by an OEM baseplate. Additionally, the slotted adapter pieces may also include certain additional structural features, such as spring-release button apertures, for interfacing with spring-release buttons included in the firearm magazines to prevent sliding disengagement of the firearm magazines from the slotted adapter pieces, as further discussed below.

In embodiments, the magazine attachment interfaces are located on opposing sides of a plane bisecting the coupler body; e.g., a plane extending substantially perpendicular to a lengthwise direction of magazine coupler and substantially parallel to a centerline of a finger aperture extending through the coupler body. In certain cases, the magazine attachment interfaces may each be joined to the coupler body in a rigid, non-articulating manner such that little to no movement occurs between the attachment interfaces and the coupler absent user disassembly of the magazine coupler. In this case, and again referencing embodiments in which the magazine attachment interfaces each include or assume the form of a slotted adapter piece, the coupler body and one or both of the slotted adapter pieces may be integrally formed as a single piece or monolithic part; e.g., an injection molded part or a machined metallic blank. Alternatively, one or both of the slotted adapter pieces may be separately fabricated as discrete components and subsequently assembled with the coupler body to yield the completed magazine coupler. In this latter regard, a given slotted adapter piece may include opposing slotted faces, while the coupler body is fabricated to include a corresponding sliding interface (herein, a "slide-lock flange"). The slide-lock flange enables the slotted adapter piece to removably attach to the coupler body utilizing a slide-lock or snap-fit interface, which may be similar to that utilized to removably mount the magazine ends to the slotted adapter pieces in embodiments. The slide-lock flange may be fabricated to include a relatively small, outwardly-projecting protuberance or "coupler-release button," which is received into an aligning opening in the slotted adapter piece when the magazine coupler is assembled to physically prevent sliding disengagement of the slotted adapter piece absent intentional user removal, as described below in connection with FIGS. 1-7. Separate or independent fabrication of the slotted adapter pieces and the coupler body may also certain benefits, including enabling fabrication of the slotted adapter pieces and the coupler body from disparate materials. Additionally, such an approach can facilitate cost effective manufacture by allowing a single, universal coupler body design (or a small number of coupler body designs) to be paired with varying slotted adapter piece designs to provide compatibility across a wide range of firearm magazine types.

When the coupler body and slotted adapter pieces (or other magazine attachment features) are fabricated as discrete or independent parts, one or both of the slotted adapter pieces may be joined to the coupler body in a non-articulating manner. In certain cases, at least one of the slotted adapter pieces may be joined to coupler body in an articulating manner allowing movement of the adapter piece (and any magazine attached thereto) relative to the coupler body in at least one degree of freedom. Allowing adapter piece movement relative to the coupler body may enable the quick change magazine coupler to transition between different positionings or states including: (i) a deployed state for active usage of the magazine coupler, and (ii) and a folded, stowable state of the magazine coupler and any magazines joined thereby. To this end, a first slotted adapter pieces may be removably joined to the coupler body in a non-articulating manner (e.g., via mounting to a slide-lock flange), while a second slotted adapter piece is hingedly joined to the coupler body in certain implementations. The coupler body may be fabricated to include a so-called "hinge support flange" or platform region to which the slotted adapter piece is hingedly joined for rotation about a pivot axis or hinge line, which may extend substantially parallel to a centerline of a central finger aperture provided through the coupler body. Such an articulating coupling (here, a hinge joint) may enable movement of the coupler body between the deployed state and the stowable state, the latter of which may generally position the coupled magazine in a side-by-side relationship for compact storage and transport Comparatively, in the deployed state of the magazine coupler, the coupled magazines (when joined via the magazine coupler) may be positioned in an opposing, inverted or "clocked" relationship; e.g., such that, when one magazine is positioned in an upright orientation with the magazine front facing a first direction, the other magazine resides in an upside-down (inverted) orientation with the magazine front facing a second, opposing direction. This enables a user to quickly transpose the positioning of the coupled magazines by, for example, rotating the magazine coupler and the coupler magazines by approximately 180 degrees utilizing an intuitive, readily-performed spinning motion.

Continuing the description above, in embodiments in which a slotted adapter piece is hingedly joined to the coupler body, the quick change magazine coupler may further include a latch mechanism to prevent undesirable pivoting of the slotted adapter piece relative to the coupler body when the magazine coupler resides in the deployed (active use) state, absent user disengagement of the latch mechanism. For example, in embodiments, a slotted adapter piece hingedly joined to the coupler body (herein, the "hingedly-joined adapter piece") may be fabricated to include a resilient latch feature, which rotates into engagement with a corresponding catch feature when the magazine coupler is rotated into the deployed state. The catch feature may be, for example, a protrusion projecting from the coupler body in a peripherally outward direction. Additionally, the catch feature may include a ramped surface adjacent a substantially flat abutment surface. The latch feature may contact the ramped surface as the hingedly-joined adapter piece rotates in a first direction (toward the deployed position), deflect as the latch feature rides along the ramped surface, and ultimately return to its non-deflected state when the latch feature rotates past the ramped surface. At this point, the latch feature contacts the flat surface or underside of the catch feature (the abutment surface) to physically prevent rotation of the hingedly-joined adapter piece in a second, opposing direction (corresponding to the folded, stowable state of the magazine coupler) until a user applies sufficient force to temporarily deflect the latch feature in an outward direction and thereby disengage the latch mechanims. In this manner, the latch mechanism blocks rotation of the hingedly-joined adapter piece to maintain the quick change magazine coupler in the deployed state until a user intentionally disengages the latch mechanism to transition the magazine coupler to the stowable state.

In addition to or in lieu of the various features discussed above, embodiments of the quick change magazine coupler may further include a central opening or through-hole (herein, a "finger aperture") provided through the coupler body. The finger aperture is sized and shaped to enable a user to insert at least one finger (and possibly multiple fingers) through the coupler body, while also facilitating spinning rotation of the magazine coupler about a finger of the user when so inserted. The finger aperture may be bound or circumscribed by an inner annular wall having a substantially smooth, stepless topology and a generally circular shape, as viewed from a side of the magazine coupler along a centerline of the finger aperture. By virtue of such features, a given user or firearm operator can readily spin the quick change magazine coupler about a user's finger (or fingers) inserted through the finger aperture to swiftly vary which of the coupled firearm magazines presently resides in a forward-facing, upright orientation for insertion into the magazine well of a firearm. Thus, through such a user-controlled spinning motion rotating the magazine coupler and the coupled magazines by approximately 180 degrees (°) about the finger aperture centerline, the relative spatial positioning of the coupled magazines can be transposed to move a fully-loaded firearm magazine into the position of a newly-emptied firearm magazine for quick insertion into the magazine well of a firearm. Users can perform such a spinning motion of the magazine coupler and the coupled magazines with a single hand in a single ergonomic motion. Further, users can perform this action with minimal, if any visual contact with the quick change magazine coupler due, at least in part, to the tactile cues provided by the coupler design and the intuitive action of spinning the magazine coupler and the coupled magazines when detached from a given firearm.

A first example embodiment of a quick change magazine coupler, which includes an articulating magazine attachment interface (e.g., a slotted adapter piece hingedly joined to the coupler body) permitting movement of the magazine coupler between a deployed (active use) state and a stowable state, is described below in connection with FIGS. 1-10. A second example embodiment of a quick change magazine coupler, which lacks an articulating magazine attachment interface, is set-forth below in connection with FIGS. 11 and 12. While described below in connection with magazine attachment interfaces containing particular structural features (namely, the below-described slotted adapter pieces), embodiments of the quick change magazine coupler can readily be adapted to permit attachment to essentially any magazine type through appropriate structural modifications to the magazine attachment interfaces, as will be apparent to one of skill in the art given the benefit of the present document. The following description, then, is provided by way of non-limiting illustration only and should not be construed to unduly restrict the scope of the appended Claims in any respect.

Figure 2:
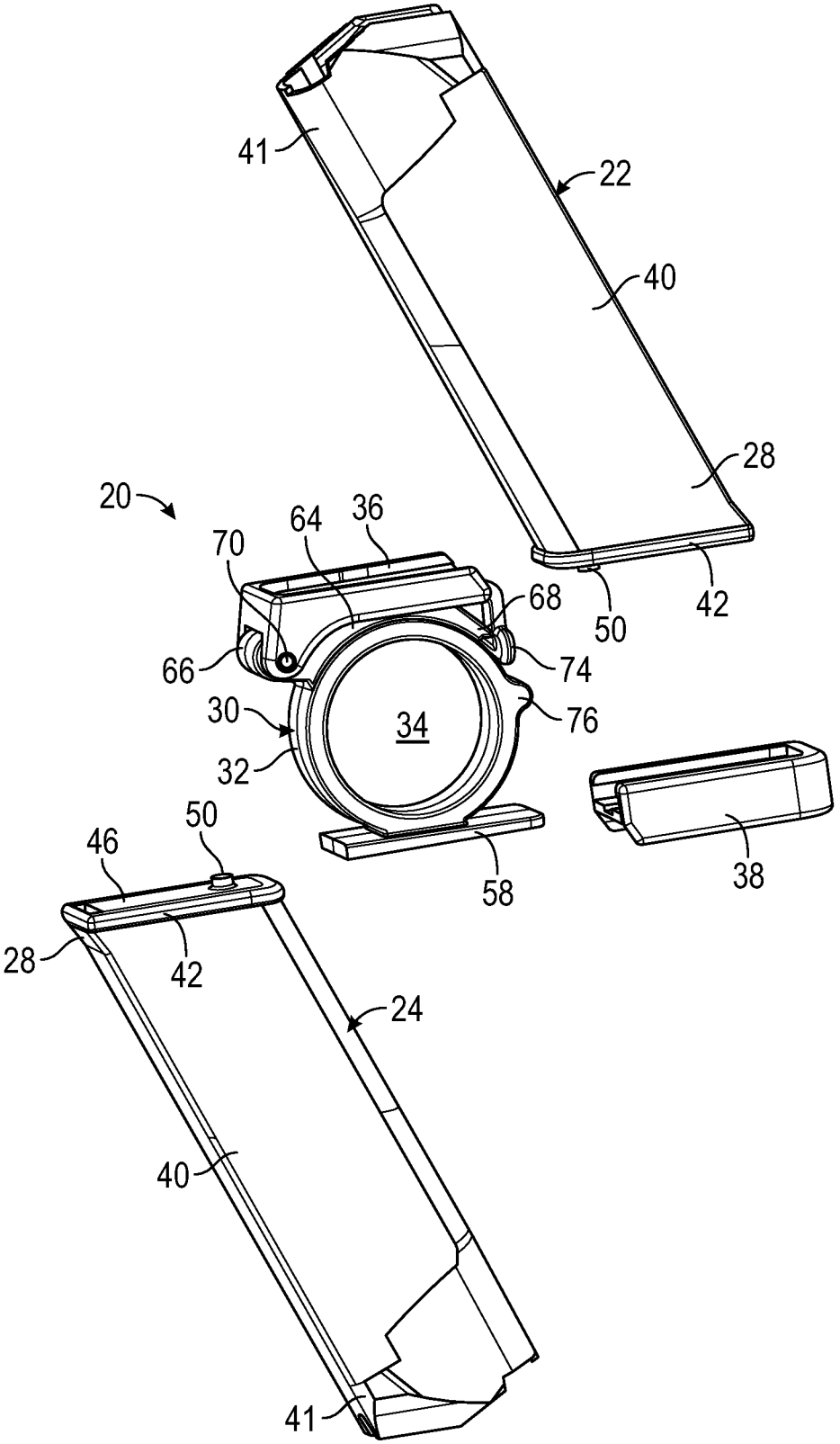
FIGS. 2 and 3 are partially-exploded and cross-sectional views, respectively, of the example quick change magazine coupler and the coupled firearm magazines shown in FIG. 1.
Figure 3:
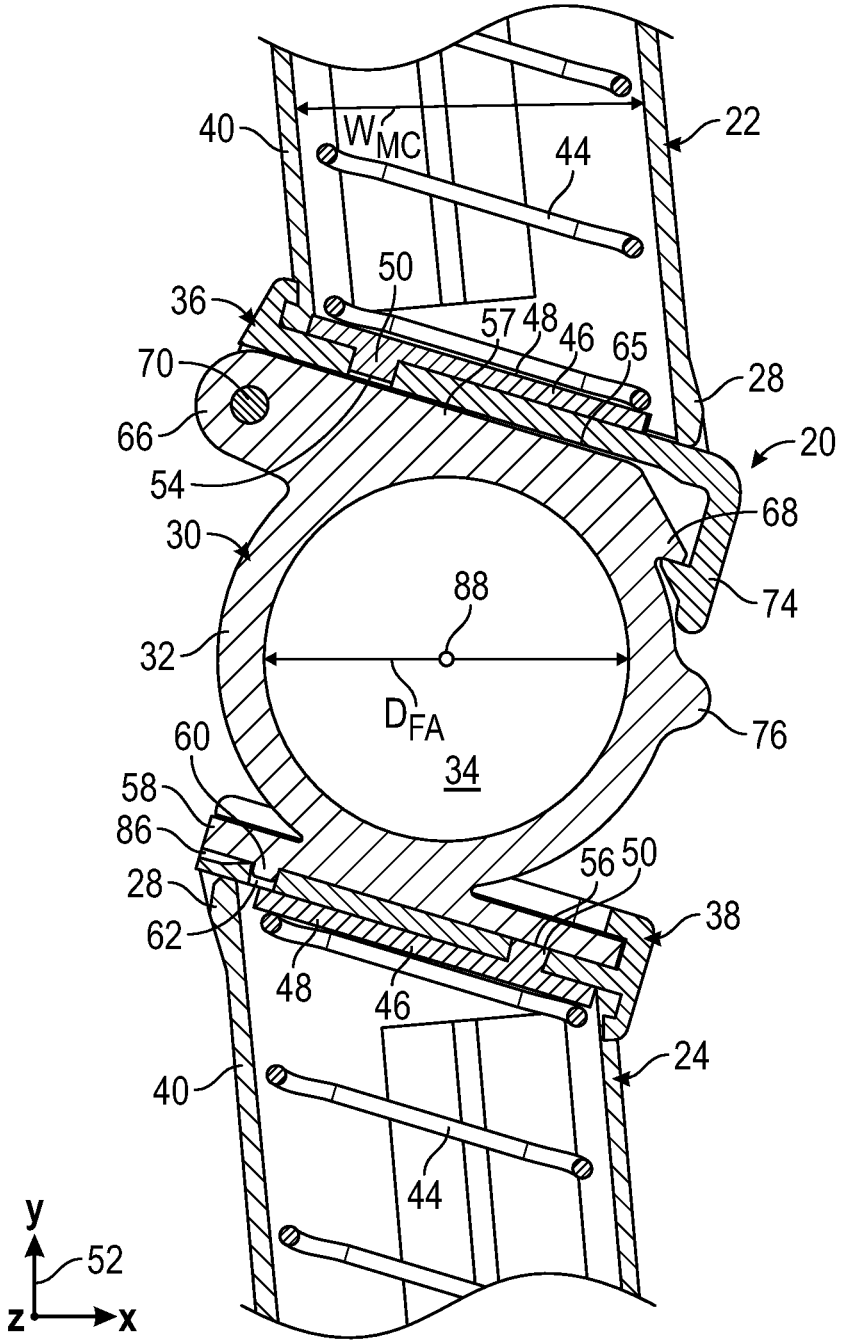

Example Quick Change Magazine Coupler Including an Articulating Slotted Adapter Piece With initial reference to FIGS. 1-3, a quick change magazine coupler 20 is illustrated in accordance with an example embodiment of the present disclosure. As shown, quick change magazine coupler 20 is beneficially utilized to removably join or physically couple two firearm magazines 22, 24 for user convenience in quickly interchanging magazines 22, 24. The coupled firearm magazines (here, magazines 22, 24) may or may not be substantially identical, providing that each magazine 22, 24 is compatible with a particular firearm type, such as firearm 26 shown in FIG. 8. The specific form factor, dimensions, and construction of firearm magazines 22, 24 joined via quick change magazine coupler 20 are generally inconsequential to embodiments of the present disclosure, providing that magazine coupler 20 (and, particularly, the opposing magazine attachment interfaces of magazine coupler 20) are capable of removably attaching to the lower ends of firearm magazines 22, 24; the term "lower," as appearing in reference to a given firearm magazine, defined with respect to the upright orientation of the firearm magazine when inserted into the magazine well of a firearm in a generally upward direction, while the firearm is held level such that firearm barrel extends in a horizontal direction. Accordingly, the lower end of firearm magazine 22 (identified by reference numeral "28") is positioned adjacent and attached to quick change magazine coupler 20. So too is the lower end of firearm magazine 24 (likewise identified by reference numeral "28") positioned adjacent and attached to magazine coupler 20, noting that firearm magazine 24 (the lower magazine in FIGS. 1-3) resides in an inverted or "upside down" orientation in the illustrated example.

Quick change magazine coupler 20 includes a coupler body 30 defined, in part, by a central ring-shaped or annular portion 32 through which a relatively large through-hole, opening, or finger aperture 34 extends. As discussed below in connection with FIG. 8, finger aperture 34 is structurally configured (that is, sized and shaped) to enable a user to readily insert at least one finger into aperture 34 and, when desired, to spin magazine coupler 20 (and therefore coupled magazines 22, 24) about a finger of the user when so inserted. In this regard, finger aperture 34 is bound or circumscribed by an inner annular wall of coupler body 30, which may be imparted with a substantially circular geometry (including slightly ovular shapes), as viewed along a centerline 88 of finger aperture 34. Additionally, the inner annular wall of coupler body 30 is beneficially imparted with a substantially smooth or stepless topology to enable a user to comfortably spin quick change magazine coupler 20 about a finger of the user; e.g., the terms "smooth" and "stepless," as appearing herein, utilized interchangeable to refer to a surface lacking features exceeding 0.5 millimeter (mm) in height. In so doing, quick change magazine coupler 20 enables a user to physically control which firearm magazine 22, 24 is presently positioned in an upright, forward-facing orientation or insertion into the magazine well of a firearm; the term "forward-facing" defined as facing away from the user and generally in the same direction as the firearm barrel when raised to a level (horizontally-extending) position by the firearm operator.

As previously noted, the diameter of finger aperture 34 (represented in FIG. 3 by double-headed arrow $D_{FA}$) is sized to permit users of various sizes to comfortably insert one or more fingers through finger aperture 34, while providing sufficient clearance between a user's inserted finger (or fingers) and the interior wall of coupler body 30 defining aperture 34 to enable a user to readily perform the below-described spinning action with magazine coupler 20. In embodiments in which the interior chamber (that is, the cartridge-containing compartment) of firearm magazine 22 and/or firearm magazine 24 has a maximum width $W_{MC}$, as taken along the X-axis of coordinate legend 52 (identified in FIG. 3 by double-headed arrow $W_{MC}$), the diameter of finger aperture 34 may be sized such that the following equation applies: $0.5(W_{MC})<D_{FA}<2(W_{MC})$. In other embodiments, the diameter of finger aperture 34 may range from about 16 mm to about 50 mm. The foregoing diameter range has been determined to be sufficiently large at its lower end (above the minimum diameter of 16 mm) to allow the majority of users to comfortably insert at least one finger into finger aperture 34, while not being excessively large (less than the upper limit of 50 mm) to provide a sufficiently limited clearance enabling users to readily spin quick change magazine coupler 20 about an inserted finger. In still other instances, the diameter of finger aperture 34 may be greater than or less than the aforementioned range.

First and second magazine attachment interfaces are coupled to (e.g., integrally formed with or otherwise joined to) opposing sides or edges of coupler body 30, as taken in a lengthwise direction of magazine coupler 20 (parallel to the Y-axis of coordinate legend 52 appearing in FIG. 3). As previously noted, the magazine attachment interfaces can each assume any structural form suitable for removably securing the lower end of a firearm magazine to coupler body 30; and, in certain cases, may include various combinations of clamps, set-screws, or clamshell mechanisms, or other such structural features, for capturing the end portion of a firearm magazine with or without the removal of existing components (e.g., an OEM baseplate) from a coupled firearm magazine. The magazine attachment interfaces of quick change magazine coupler 20 may be substantially identical in embodiments or, instead, may differ relative to one another in varying respects. In the example embodiment shown in FIGS. 1-3, specifically, the magazine attachment interfaces of quick change magazine coupler 20 include or assume the form of two slotted adapter pieces 36, 38, which are similar in certain respects, but differ in others. As indicated by the term "slotted," slotted adapter pieces 36, 38 include cavities or slots enabling lower end portions 28 of firearm magazines 22, 24 to slidably engage with or mate to adapter pieces 36, 38; e.g., slotted adapter pieces 36, 38 may be configured to slide into engagement with a lower end portion 28 of firearm magazines 22, 24 following removal of an existing (e.g., OEM) baseplate, which typically encloses the lower tubular ends of firearm magazine bodies 40. Additional description of potential manners in which slotted adapter pieces 36, 38 may be joined to coupler body 30 in the illustrated embodiment is provided below in connection with FIGS. 4-7. First, however, firearm magazines 22, 24 are described in greater detail to establish an illustrative, non-limiting context in which embodiments of quick change magazine coupler 20 may be better understood.

With continued reference to FIGS. 1-3, firearm magazines 22, 24 each include a tubular magazine body 40 having an upper end portion 41 (FIG. 1) and a lower end portion 28, which is located opposite upper end portion 41 in a lengthwise direction (parallel to the Y-axis of coordinate legend 52 in FIG. 3). Lower exterior magazine flanges, lips, or tabs 42 (FIG. 2) project outwardly from bottom lateral edges of lower end portion 28 in opposing lateral directions, as seen most clearly in FIG. 2. Magazine tabs 42 are engaged by slotted adapter pieces 36, 38 when securing magazines 22, 24 to quick change magazine coupler 20. In the case of each firearm magazine 22, 24, tubular magazine body 40 may be fabricated by rolling or otherwise forming sheet metal into a desired rectangular tubular shape, with magazine tabs 42 bent into their desired orientation during the metal forming process. This stated, the particular manner in which firearm magazines 22, 24 are manufactured is largely inconsequential to embodiments of the present disclosure, as is the specific structural design of firearm magazines 22, 24. Further, as shown in the cross-section of FIG. 3, each magazine 22, 24 includes a magazine spring 44 disposed within the interior channel or chamber of tubular magazine body 40. Magazine spring 44 extends within the interior channel of each firearm magazine 22, 24, while being compressed between an upper spring follower (hidden from view) and a lower spring-release plate 46. Magazine spring 44 will often assume the form of a wireform compression spring having generally rectangular coils, as shown; however, a different type of mechanical or gas spring (or other bias element) can be substituted for magazine spring 44 in alternative implementations.

The spring-release plate 46 contained in each firearm magazine 22, 24 includes spring seat surface 48, which is contacted by a lower end portion of magazine spring 44. A lower, generally cylindrical protuberance or "spring-release button" 50 extends from spring-release plate 46 in a downward direction generally away from spring seat surface 48, as taken along the Z-axis of a coordinate legend 52 (FIG. 3); again the term "downward," as utilized in this context, defined with respect to a frame of reference in which a given firearm magazine is positioned in an upright orientation.

Further, as shown most clearly in FIG. 3, each spring-release button 50 is received into an aligning opening, through-hole, or aperture provided in the corresponding slotted adapter piece 36, 38 when firearm magazines 22, 24 are removably attached to quick change magazine coupler 20. Addressing slotted adapter piece 36, in particular, the spring-release button 50 extends from spring-release plate 46 of firearm magazine 22 and is received into an aperture 54 provided in slotted adapter piece 36, with aperture 54 generally aligning with spring-release button 50 in a lengthwise direction of magazine coupler 20 when firearm magazine 22 is slid into full mating engagement with adapter piece 36. Similarly, spring-release button 50 included in spring-release plate 46 of firearm magazine 24 is likewise received into an aligning aperture 56 provided in slotted adapter piece 36 when firearm magazine 24 is properly attached to magazine coupler 20. The interaction between spring-release buttons 50 and apertures 54, 56 provides a slide-lock interface, which prevents inadvertent sliding detachment of lower end portions 28 of firearm magazines 22, 24 from slotted adapter pieces 36, 38.

In addition to central annular portion 32, coupler body 30 further includes two platform regions or flanges 57, 58 to which slotted adapter pieces 36, 38 attach, respectively. For reasons that will become apparent, coupler body flange 57 is referred to more fully below as a "hinge support flange 57," while the opposing coupler body flange 58 is referred to below as a "slide-lock flange 58." Hinge support flange 57 is generally located opposite slide-lock flange 58, as taken in a lengthwise direction of magazine coupler 20 (parallel to the Y-axis of coordinate legend 52), with finger aperture 34 located between flanges 57, 58. In the illustrated example, hinge support flange 57 includes a principal support surface 65 (identified in FIG. 3), here having a substantially flat topology. Support surface 65 of hinge support flange 57 faces away from finger aperture 34 and toward slotted adapter piece 36 when quick change magazine coupler 20 resides in the deployed state, as shown FIGS. 1-3. Hinge support flange 57 also includes a hinge pin boss 66, as well as a catch feature 68. Catch feature 68 is spaced from hinge pin boss 66 by a predetermined distance, as taken along the outer periphery of coupler body 30, to position catch feature 68 for engagement with the below-described latch feature 74 of slotted adapted piece 36. A hinge pin 70 extends through a tubular hinge pin channel provided through hinge pin boss 66, with pin 70 further received through aligning openings or eyelets 72 provided in slotted adapter piece 36 (identified in FIG. 4). The hinge pin channel may extend substantially parallel to the hinge line or axis of quick change magazine coupler 20 and finger aperture centerline 88, which each extend parallel to the Z-axis of coordinate legend 52 (FIG. 3) in the illustrated embodiment.

Slotted adapter piece 36 is thus pivotally joined to coupler body 30 and can rotate relative thereto when so permitted; e.g., slotted adapter piece 36 may rotate relative to coupler body 30 when the below-described latch mechanism is disengaged to, for example, allow magazine coupler 20 to transition from the deployed state (the positioning or posture shown in FIGS. 1-3) to a folded, stowable state. During assembly of quick change magazine coupler 20, and referring briefly to FIG. 4, slotted adapter piece 36 may be hingedly joined to hinge support flange 57 of coupler body 30 by first placing adapter piece 36 in its proper position such that the two hinge pin openings or eyelets 72, which are provided through adapter piece 36, align axially with the hinge pin opening or channel provided through hinge pin boss 66 of hinge support flange 57. Hinge pin 70 is then inserted through the aligning openings to hingedly join slotted adapter piece 36 and coupler body 30, with hinge pin 70 retained in its desired position utilizing, for example, a friction or press fit After or prior to attachment of slotted adapter piece 36 to coupler body 30, slotted adapter piece 38 is similarly joined to slide-lock flange 58 of coupler body 30, as further discussed below in connection with FIG. 5.

In the illustrated embodiment, quick change magazine coupler 20 is produced to include a latch mechanism 68, 74, which is formed by the combination of catch feature 68 of coupler body 30 and a corresponding latch feature 74. To provide the desired latching function, latch feature 74 is positioned, shaped, and dimensioned to engage catch feature 68 as slotted adapter piece 36 rotates relative to coupler body 30. Latch feature 74 extends toward slotted adapter piece 36 to engage catch feature 68 when slotted adapter piece 36 is rotated to transition quick change magazine coupler 20 into the deployed state shown in FIGS. 1-3. Latch feature 74 can be deflected in an outward direction (away from coupler body 30) when manipulated by a user to temporarily remove latch feature 74 from abutment with the flat edge of catch feature 68. When latch feature 74 is deflected or "unhooked" by the user in this manner, slotted adapter piece 36 is thus released to freely rotate relative to coupler body 30 about the hinge line axis and, more generally, about hinge pin 70, thereby allowing the user to position magazine coupler 20 in the more compact, stowable state for storage or transport, as discussed below in connection with FIG. 9. Finally, in embodiments, quick change magazine coupler 20 may also include a protective fingerguard 76, which may be located adjacent the interface between latch feature 74 and catch feature 68. When present, fingerguard 76 may be formed as a localized, rounded protrusion, which projects from central annular portion 32 of coupler body 30 in a radially-outward direction at a location adjacent catch feature 68. Fingerguard 76 provides a convenient locationing or support feature for positioning a user's thumb or other finger when grasping magazine coupler 20. Concurrently, fingerguard 76 minimizes the likelihood of inadvertent positioning of the user's thumb between latch feature 74 and catch feature 68 when slotted adapter piece 36 is rotated or pivoted from a stowable position into the deployed position shown in FIGS. 1-3.

As indicated in FIG. 3, latch feature 74 may be integrally formed with the remainder of slotted adapter piece 36 as a single (e.g., injection molded) part for manufacturing efficiency. The inherent resiliency of the material from which slotted adapter piece 36 is composed, such as a polymer, may provide latch feature 74 with the ability to deflect and then return to its non-deflected state as previously indicated. This allows a user to utilize the user's fingers to pinch or otherwise grasp latch feature 74 to deflect latch feature 74 away from coupler body 30 and thereby disengage or unfasten latch mechanism 68, 74 when desired. Stated differently, a user can deflect or bend latch feature 74 in an outward direction (away from coupler body 30) to disengage from abutting contact with the flat edge of catch feature 68, thus releasing slotted adapter piece 36 for rotation about hinge pin 70 relative to coupler body 30. Conversely, when hingedly-joined adapter piece 36 rotates in a first rotational direction (toward the deployed position), latch feature 74 is brought into contact with catch feature 68 and deflects as latch feature 74 rides along the ramped or slanted surface of catch feature 68. When sliding beyond the ramped surface of catch feature 68 as slotted adapter piece 36 rotates into a position resting against support surface 65 of hinge support flange 57, latch feature 74 returns to its non-deflected state to abut the flat surface or underside of the catch feature 68.

So positioned, latch feature 74 physically prevents or blocks rotation of slotted adapter piece 36 in a second, opposing direction to effectively lock adapter piece 36 in the deployed position. In so doing, latch mechanism 68, 74 prevents rotation of adapter piece 36 (and, by extension, firearm magazine 22) relative to coupler body 30 to maintain the quick change magazine coupler 20 in the deployed state until the user or firearm operator again disengages latch mechanism 68, 74 to transition magazine coupler 20 to the stowable state.

In the illustrated example embodiment of quick change magazine coupler 20, slotted adapter piece 38 is removably coupled to slide-lock flange 58 included in coupler body 30. As indicated by the term "slide-lock," slotted adapter piece 38 is joined to slide-lock flange 58 utilizing a sliding, interlocking interface, which may be similar to that utilized to removably join slotted adapter piece 38 to lower end portion 28 of firearm magazine 24 in certain respects. This may be appreciated most readily with reference to FIG. 5, which depicts quick change magazine coupler 20 in an inverted orientation relative to the orientation shown in FIGS. 1-4. Extending along one side or face of adapter piece 38, slotted adapter piece 38 includes a pair of laterally-spaced, inwardly-projecting rails 80, which help define or bound an open slot in which slide-lock flange 58 is received. Rails 80 engage and slide against the inboard surface or underside of slide-lock flange 58 facing annular portion 32 of coupler body 30 when a user inserts slotted adapter piece 38 onto slide-lock flange 58. As further identified in FIG. 5, slide-lock flange 58 includes a substantially flat surface 64, which faces slotted adapter piece 38 when joined to coupler body 30 and which includes a small protrusion 60 (herein, a slide-lock button 60) projecting outwardly therefrom. An end portion of slide-lock flange 58 furthest slide-lock button 60 is received into an open end 82 of slotted adapter piece 38, with rails 80 sliding against the inboard surface or underside of slide-lock flange 58 facing annular portion 32 of coupler body 30. A close-fit mating interface is thus provided preventing movement of slotted adapter piece 38 relative slide-lock flange 58 along the Z- and Y-axes of coordinate legend 52. During assembly of quick change magazine coupler 20, slotted adapter piece 38 may be slid into engagement with slide-lock flange 58 in the manner indicated by arrow 78 (also representing the "insertion axis" along which dual-faced, slotted adapter piece 38 is inserted onto or slid into engagement with slide-lock flange 58 of coupler body 30).

As slotted adapter piece 38 is slid into its appropriate position, slot floor 94 of adapter piece 38 (and, more specifically, the wall through which apertures 56, 62 are formed) deflects to a sufficient extent to allow the passage of slide-lock button 60 beneath slot floor 84 until button 60 is brought into alignment with aperture 62. When this occurs, slide-lock button 60 extends into slide-lock button aperture 62, with slotted adapter piece 38 resiliently returning to its non-deflected state to prevent sliding disengagement of slotted adapter piece 36 from slide-lock flange 58 along the X-axis of coordinate legend 52 in a direction opposite arrow 78. If a user subsequently wishes to detach slotted adapter piece 38 from slide-lock flange, the user may initially insert or wedge the flat edge of a flat head screwdriver, a coin, or another tool into a gap 86 (identified in FIG. 3) provided between an outer edge of slide-lock flange 58 and an edge portion of slotted adapter piece 38 adjacent slide-lock button 58. Afterwards, the user may then move the tool or object in such a way to increase the height of gap 86 (FIG. 3), temporarily deflecting slot floor 94 away from flange 58, in a manner withdrawing slide-lock button 60 from the slide-lock button aperture 62 formed through slotted adapter piece 38. This removes the structural interference between slide-lock button 60 and the walls of aperture 62 to free slotted adapter piece 38 to again slide relative to slide-lock flange 58 in a direction opposite arrow 78 (FIG. 8), thereby allowing the user to remove slotted adapter piece 38 from coupler body 30 when so desired.

Figure 5:
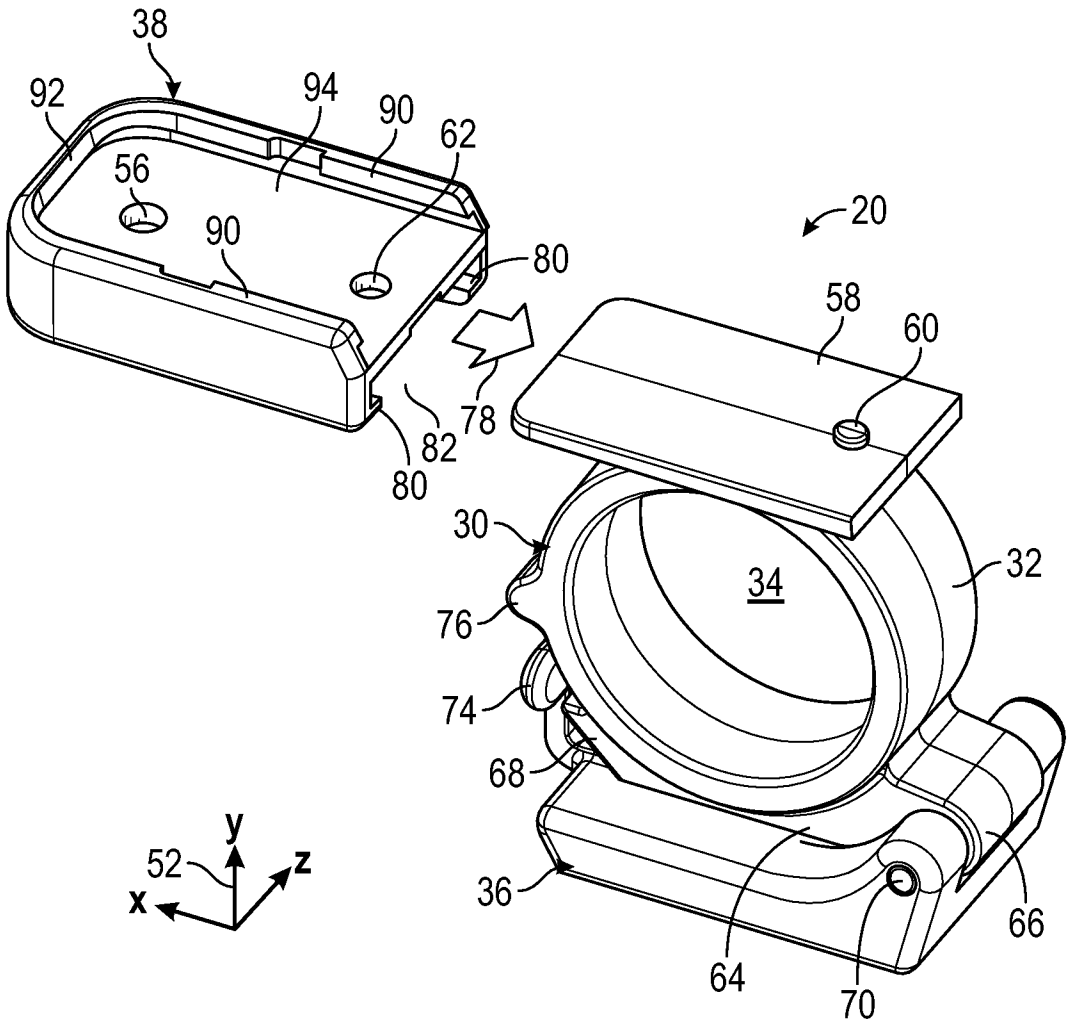
FIGS. 4 and 5 illustrate the example quick change magazine coupler shown in FIGS. 1-3 at different stages of assembly.
Figure 4:
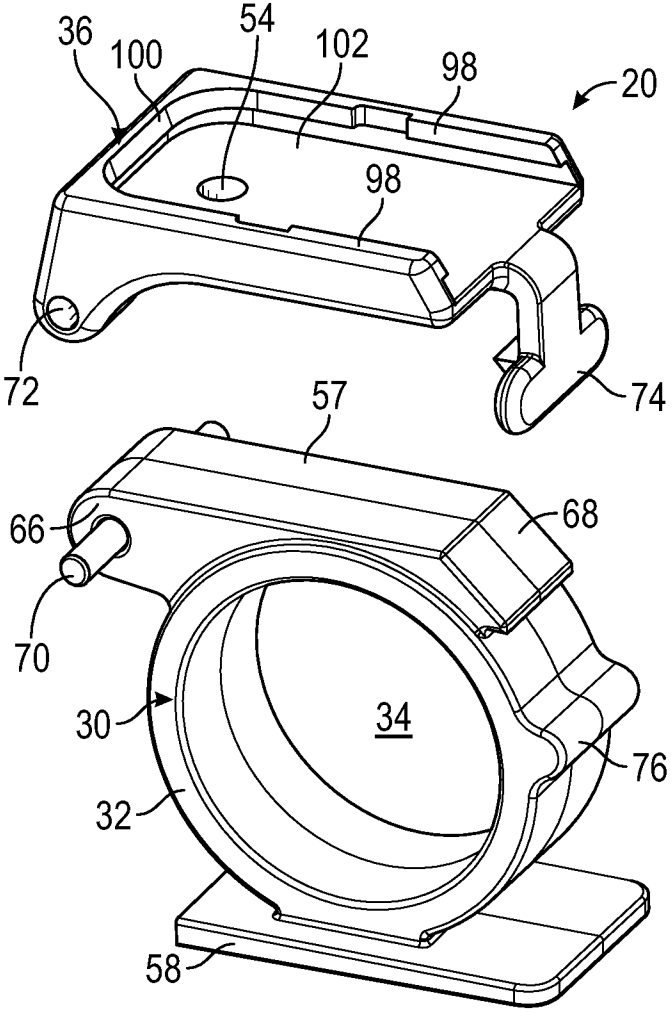
Figure 6:
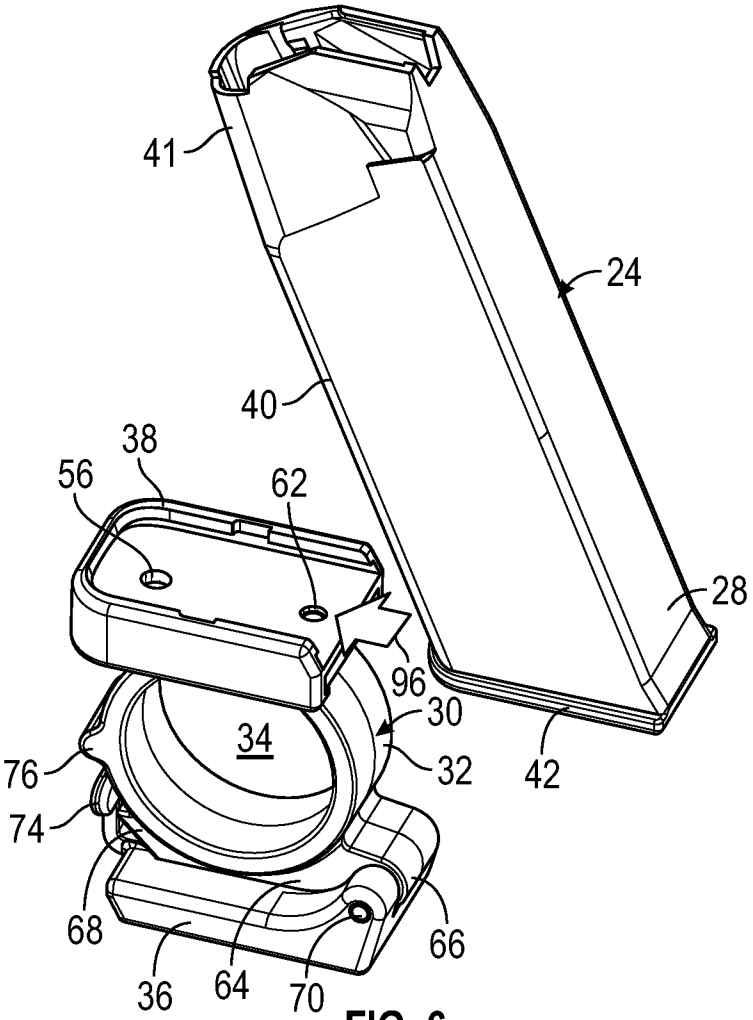

With magazine coupler 20 assembled as just described in connection with FIGS. 4 and 5, a user having purchased or otherwise obtained quick change magazine coupler 20 may now attach two firearm magazines (e.g., the illustrated firearm magazines 22, 24) to magazine coupler 20 and, specifically, to slotted adapter pieces 36, 38. The particular order in which the selected firearm magazines are attached to quick change magazine coupler 20 is inconsequential; however, by way of example, FIG. 6 illustrates initial attachment of firearm magazine 24 to slotted adapter piece 38, while quick change magazine coupler 20 resides in an inverted orientation corresponding that shown in FIG. 5. Referring principally to FIGS. 3, 4, and 6, and as labeled exclusively in FIG. 4, the outer slotted face of dual-sided slotted adapter piece 38 opposite coupler body 30 includes laterally-spaced side rails 90, an end rail 92, and a slot floor 94 penetrated by both spring-release button aperture 56 and slide-lock button aperture 62. Side rails 90, 92, and slot floor 94 cooperate to define a relatively shallow, partially-open cavity or slot, which is partially enclosed by side rails 90, 92. As indicated in FIG. 6 by arrow 96 (also representing the "insertion axis" along which firearm magazine 24 engages slotted adapter piece 38), lower end portion 28 of firearm magazine 24 is slid into engagement with the partially-open cavity or slot of slotted adapter piece 38 to attach or mount firearm magazine 24 to coupler body 30. The outwardly-projecting lateral tabs 42 of firearm magazine 24 are captured between lateral rails 90 and cavity floor 94 of slotted adapter piece 38 as slotted adapter piece 38 is slid into engagement with firearm magazine 24. Accordingly, the depth of the cavity or slot of adapter piece 38, as taken from lateral rails 90 to floor 94, is substantially equivalent to the height or thickness of magazine tabs 42, as shown. Lower end portion 28 of firearm magazine 24 is thus captured against slotted adapter piece 38 in a manner preventing movement of firearm magazine 24 in all degrees of freedom (including movement of magazine 24 in a direction directly away from coupler body 30) with exception of movement of magazine 24 along the insertion axis, as represented by arrow 96 in FIG. 6.

As firearm magazine 24 is slid into full engagement with slotted adapter piece 38, magazine spring 44 (FIG. 3) compresses slightly to allow the retraction of spring-release button 50, which rides along an initial, smooth portion of cavity floor 94 until ultimately aligning with spring-release button aperture 62. Spring-release button 50 may also pass over slide-lock button aperture 62 as firearm magazine 24 is moved relative to slotted adapter piece 38 in this manner; however, spring-release button 50 is generally not received into slide-lock button aperture 62 when passing thereover considering that aperture 62 is already partially, if not wholly occupied by button 60 projecting from slide-lock flange 58. When firearm magazine 24 is fully moved into its attached position, a lower leading edge of firearm magazine 24 may abut end rail 92 (FIG. 4). Concurrently, spring-release button 50 is brought into alignment with spring-release button aperture 62, thereby allowing button 50 to extend into aperture 62 as spring-release plate 46 is moved toward slotted adapter piece 38 by the expansive force of the magazine spring 44 contained in firearm magazine 24. To subsequently detach firearm magazine 24 from quick change magazine coupler 20, when desired, a user initially removes slotted adapter piece 38 from coupler body 30 to reveal the side or principal surface of slotted adapter piece 38 facing away from firearm magazine 24. This provides physical access to spring-release button 50 through spring-release button aperture 56, allowing the user to then depress spring-release button 50 utilizing a suitable tool (e.g., the tip of a pen, a paperclip, or a similar tool having a narrow extension) to retract spring-release button 50 into spring-release button aperture 56 and remove firearm magazine 24 by sliding firearm magazine 24 from slotted adapter piece 38 in a direction opposite arrow 96 (FIG. 6).

Figure 7:
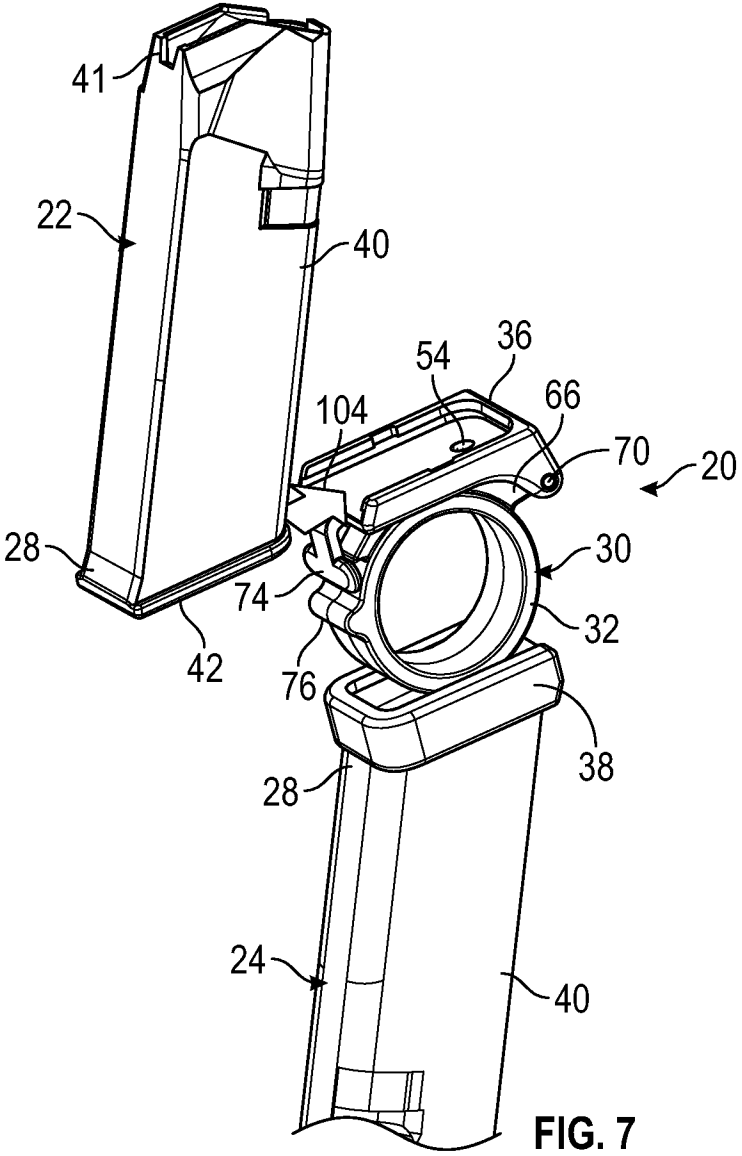
FIGS. 6 and 7 illustrate one manner in which a first firearm magazine and a second firearm magazine (e.g., the firearm magazines shown in FIGS. 1-3) may be sequentially attached to the quick change magazine coupler, respectively.

With firearm magazine 24 now secured to slotted adapter piece 38, a substantially identical slide-lock attachment approach may be utilized to removably secure firearm magazine 22 to hingedly-joined slotted adapter piece 36 in embodiments. Accordingly, and referring principally to FIGS. 3, 5 and 7, the face of slotted adapter piece 36 located opposite coupler body 30 may be fabricated to include laterally-space side rails 98, an end rail 100, and a slot floor 102 penetrated by spring-release button aperture 54. Rails 98, 100, and floor 102 cooperate to define a relatively shallow, partially-open cavity or slot, which is enclosed by side rails 98, 100 along its lateral edges. As indicated in FIG. 7 by arrow 104 (also representing the "insertion axis" along which firearm magazine 22 engages slotted adapter piece 36), lower end portion 28 of firearm magazine 22 is slid into engagement with slotted adapter piece 36 to attach firearm magazine 22 to coupler body 30 in a manner analogous to that just described. Lateral tabs 42 projecting from the lower edge of firearm magazine 22 (revealed by removal of an existing, non-illustrated baseplate of magazine 22) are again captured between lateral rails 98 and slot floor 102 of slotted adapter piece 36 to constrain the movement of firearm magazine 22 to translational or sliding movement along the insertion axis represented by arrow 104. As a user slides firearm magazine 22 into engagement with slotted adapter piece 36, magazine spring 44 (FIG. 3) compresses slightly to allow the retraction of spring-release button 50, which then rides or travels along an initial, smooth portion of cavity floor 102 until aligning with spring-release button aperture 54. When firearm magazine 24 is brought into its proper attached position, spring-release button 50 aligns with spring-release button aperture 54. Spring-release button 50 thus extends into aperture 54 as spring-release plate 46 is moved toward the lower opening of firearm magazine 22 under the expansive force of the internal magazine spring 44.

In the above-described manner, the structural interaction between the interior wall of slotted adapter piece 36 defining spring-release button aperture 54 and spring-release button 50, now descended into spring-release button aperture 54, block or physically prevent withdrawal of the lower end portion 28 of firearm magazine 22 along the insertion axis represented by arrow 104. This structural interference between button 50 and the aperture 54 effectively locks firearm magazine 22 to slotted adapter piece 36. A highly robust attachment interface is thus provided securing firearm magazine 22 to slotted adapter piece 36 and, more generally, to quick change magazine coupler 20 in a manner preventing inadvertent disengagement of magazine 22, including in the event of significant impact or shock forces imparted to magazine coupler 20 or firearm magazine 22. So too is firearm magazine 24 securely affixed to magazine coupler 20 via slotted adapter piece 38, as previously described. This completes user attachment of firearm magazines 22, 24 to quick change magazine coupler 20 to yield the assembly shown in FIGS. 1-3. To subsequently detach firearm magazine 24 from quick change magazine coupler 20, a user rotates adapter piece 36 into the below-described folded, stowable position to reveal spring-release button 50 through spring-release button aperture 54. The user then depresses spring-release button 50 utilizing a suitable tool to retract button 50 into aperture 56 and remove firearm magazine 22 by sliding firearm magazine 22 from slotted adapter piece 36 in a direction opposite arrow 104 (FIG. 7).

Figure 8:
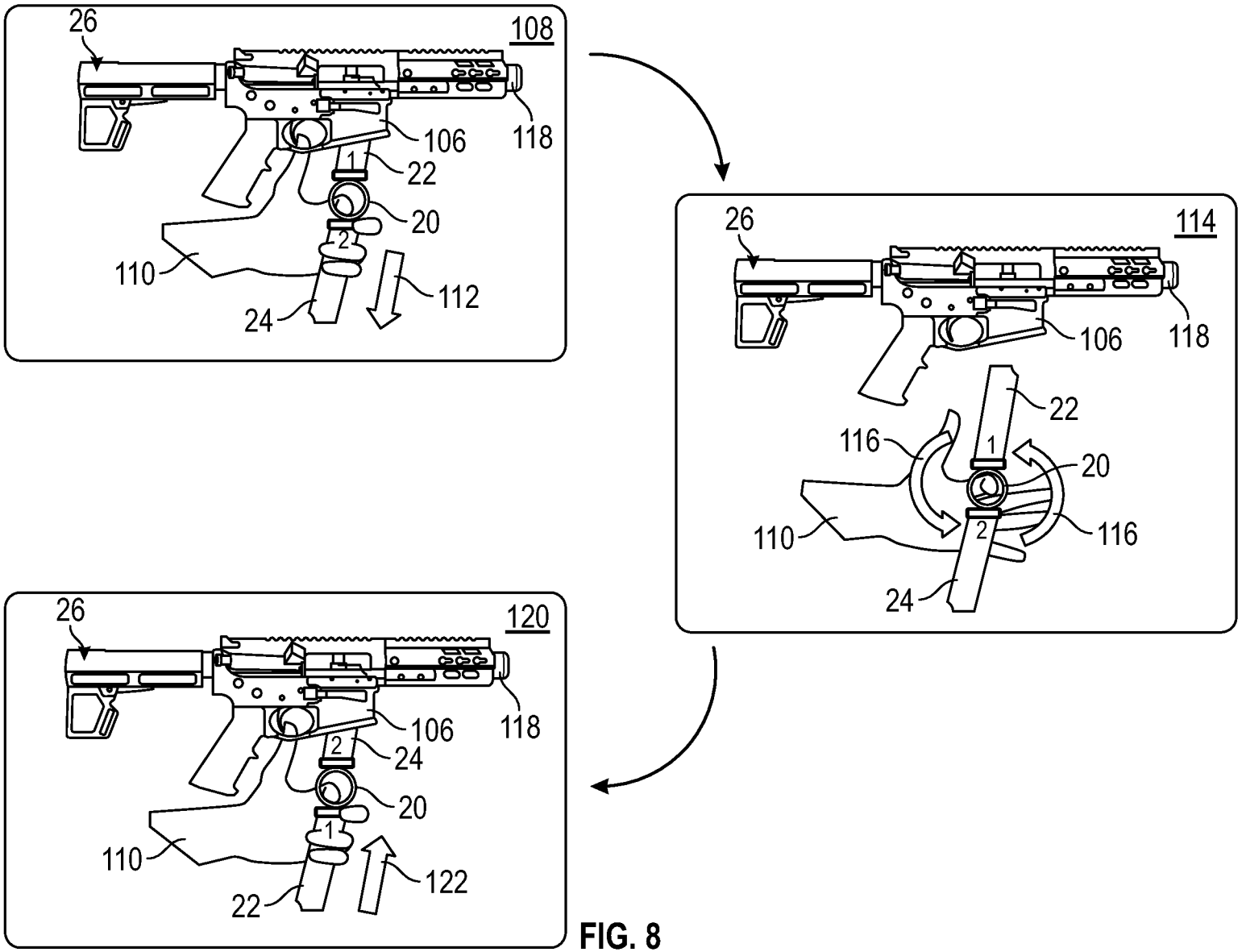
FIG. 8 illustrates, in a step-by-step sequence, one manner in which a user may spin the quick change magazine coupler, as well as the firearm magazines joined via the magazine coupler, about a finger of the user when inserted through a finger aperture of the magazine coupler to vary which firearm magazine presently resides in an upright orientation for insertion into the well of a firearm.

Referring now to FIG. 8, one manner is depicted in which quick change magazine coupler 20 may enable a user (a firearm operator) to spin magazine coupler 20 about the user's finger to quickly and intuitively vary which of magazines 22, 24 presently resides in an upright, forward-facing orientation for insertion into magazine well 106 of a firearm 26. Here, consider a scenario in which firearm magazine 22 has emptied in conjunction with discharge of firearm 26, and the user or firearm operator now desires to rapidly interchange the newly-emptied magazine 22 with fully-loaded firearm magazine 24. In a first step (panel 108), a user grasping quick change magazine coupler 20 and a lower portion of firearm magazine 24 with the user's hand 110 pulls magazine coupler 20 and coupled magazines 22, 24 in a generally downward (as indicated by arrow 112) to withdraw magazine 22 from magazine well 106. Next, as indicated in panel 114, and while at least one finger of the user is inserted through finger aperture 34 of magazine coupler 20, the user spins magazine coupler 20 and coupled magazines 22, 24 in a clockwise or counterclockwise direction by approximately 180° to transpose the respective spatial positioning of coupled magazines 22, 24, as indicated by arrows 116. This brings the second, fully-loaded firearm magazine 24 into an upright orientation, while also ensuring that firearm magazine 24 is facing the appropriate direction (the magazine front pointing in the same direction as the barrel 118 of firearm 26) for immediate insertion into magazine well 106, as indicated in the final panel 120 of FIG. 8 by arrow 122. Concurrently, newly-emptied firearm magazine 22 is rotated into an inverted, rear-facing position. This transposition occurs due to the manner in which magazine coupler 20 positions firearm magazines 22, 24 in an approximate 180° clocked relationship, as taken about a centerline 88 of finger aperture 34 (identified in FIGS. 1 and 3); although the angular relationship between firearm magazines 22, 24 to vary when attached to magazine coupler 20 in alternative embodiments. The user (firearm operator) can thus manipulate quick change magazine coupler 20 to quickly interchange coupled magazines 22, 24 through such an intuitive spinning motion, even when performed single-handedly and the user is presented with adverse scenarios in which minimal visual contact may be maintained with magazine coupler 20.

Figure 9:
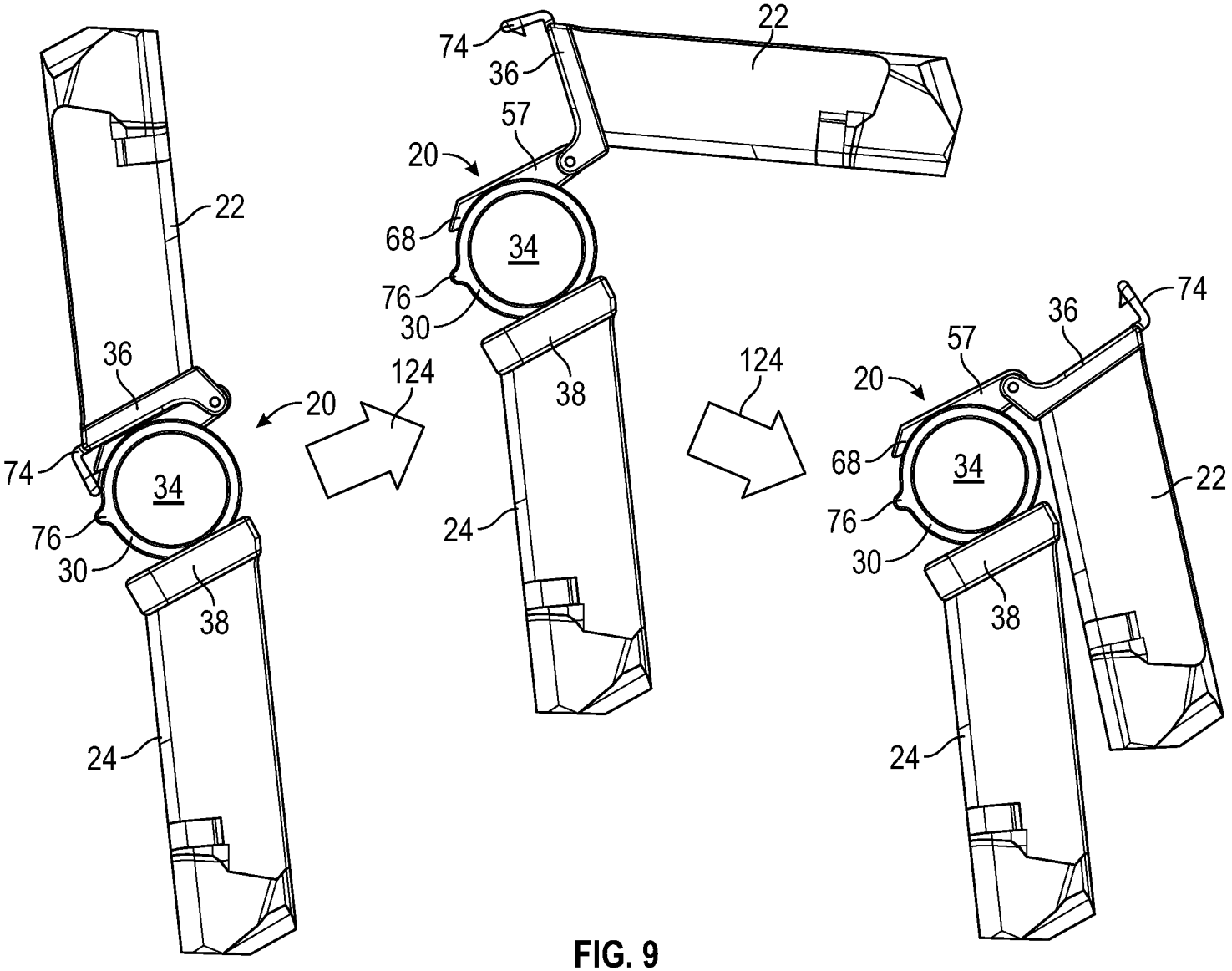
FIG. 9 illustrates, in a step-by-step sequence, one manner in which a user may transition the example quick change magazine coupler from the deployed state (FIGS. 1-3 and 8) to a folded, stowable state by rotation of the first slotted adapter piece relative to the coupler body about a hinge line.

Turning next to FIG. 9, one manner in which quick change magazine coupler 20 may transition from the deployed state (the positioning or posture shown in FIGS. 1-3 and 8) to a stowable state by user-rotation of first slotted adapter piece 36 relative to coupler body 30 is presented. As can be seen in this drawing figure, the hinged coupling between slotted adapter piece 36 and coupler body 30 enables slotted adapter piece 36, and therefore coupled firearm magazine 22, to rotate about a hinge line or axis extending substantially parallel to finger aperture centerline 88 (FIGS. 1 and 3) when latch mechanism 68, 74 is disengaged by a user. Rotation of slotted adapter piece 36 (and firearm magazine 22) relative to coupler body 30 in this manner permits movement of quick change magazine coupler 20 between the deployed state or posture (shown on the left of FIG. 9) to folded, stowable state shown on the right of FIG. 9. As indicated by arrows 124, when magazine coupler 20 is moved by the user into the stowable state by rotation of slotted adapter piece 36 relative to coupler body 30 in a first rotational direction (clockwise in the illustrated orientation), firearm magazines 22, 24 may be placed in an approximate side-by-side relationship, with both magazines 22, 24 now facing in the same general direction. This enables quick change magazine coupler 20 to transition between from a deployed state to a folded, stowable state for ready storage or user transport in a magazine holder, a container, or other storage vessel. Conversely, when slotted adapter piece 36 is rotated in the opposing direction (opposite arrows 124) from the stowable state toward the deployed state, latch feature 74 engages catch feature 68 to rotationally lock quick change magazine coupler 20 in the deployed (active use) state until a user again deflects latch feature 74 to disengage latch mechanism 68, 74, as previously described.

Figure 10:
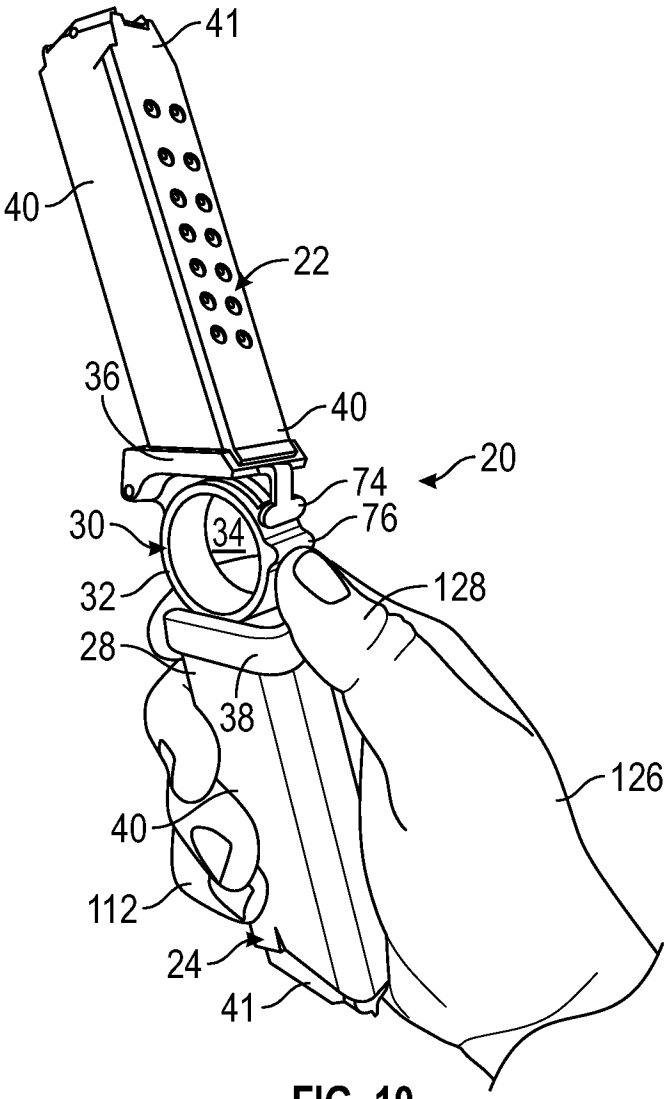
FIG. 10 is an isometric view of the quick change magazine coupler in the deployed state and illustrating an example user finger positioning when grasping the magazine coupler including an example user thumb position relative to a fingerguard, which may project from an outer periphery of the coupler body at a location adjacent a latching mechanims in the example embodiment.

Addressing lastly FIG. 10, a potential user finger positioning relative to fingerguard 76 when grasping or otherwise physically manipulating quick change magazine coupler 20 and firearm magazines 22, 24 is shown. In this example scenario, a user or firearm operator grasps quick change magazine coupler 20 and firearm magazine 24 with one of the user's hands 126. The user holds magazine coupler 20 such that the user's thumb 128 presses against or rests upon fingerguard 76. As previously noted, fingerguard 76 projects outwardly from the central annular portion 32 of coupler body 30 in a peripherally-outward direction at a location adjacent catch feature 68 when quick change magazine coupler 20 resides in the deployed state. In so doing, fingerguard 76 decreases the likelihood of inadvertent positioning of the user's thumb 128 or other fingers between catch feature 68 and latch feature 74 as magazine coupler 20 swings into the deployed state (FIGS. 1-3 and 8) from the stowable state shown in FIG. 9. Additionally, fingerguard 76 provides an intuitive tactile cue to enable a user to rapidly gain awareness of the positioning of quick change magazine coupler 20 through touch when the user grasps magazine coupler 20 and firearm magazines 22, 24. This, taken in combination with the above-described unique spinning motion by which quick change magazine coupler 20 enables the coupled firearm magazines 22, 24 to be transposed, may enable the user to effectuate magazines changes utilizing magazine coupler 20 in a rapid manner, while maintaining minimal visual contact with magazine coupler 20 and the coupled firearm magazines 22, 24.

Alternative Embodiment of the Quick Change Magazine Coupler

Figure 11:
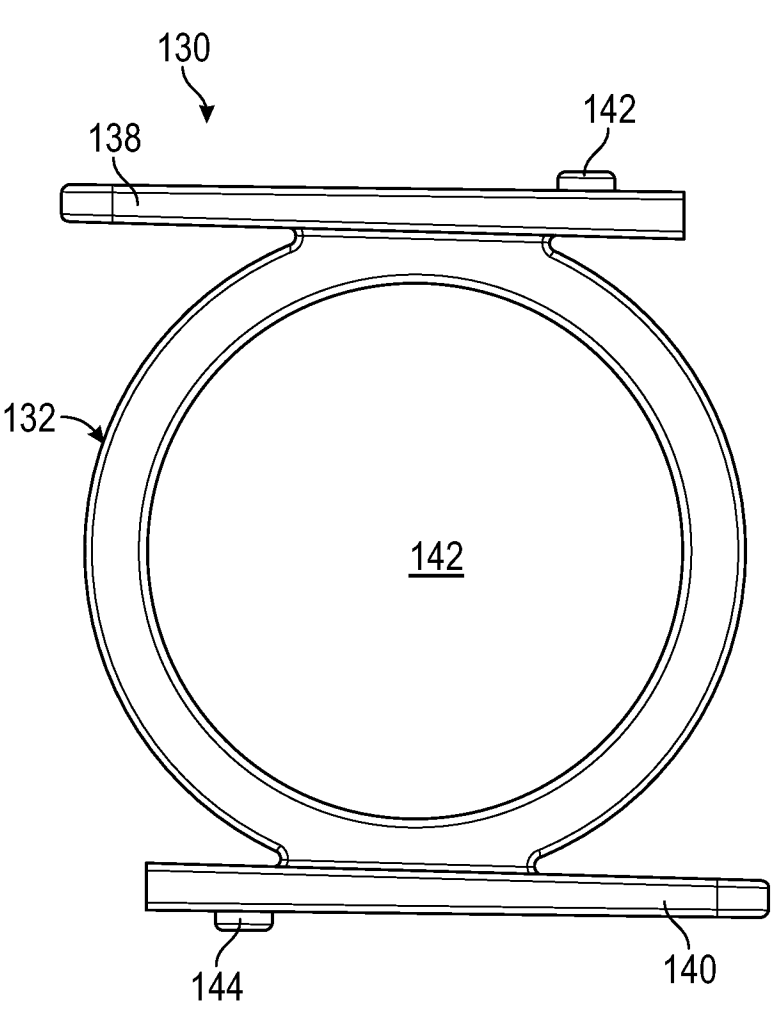
FIGS. 11 and 12 are side and cross-sectional views, respectively, of a quick change magazine coupler similar to the example magazine coupler shown in FIGS. 1-10, but implemented as a non-articulating assembly lacking a hinge joint and including two slotted adapter pieces (shown in FIG. 12), as illustrated in accordance with a further example embodiment of the present disclosure.
Figure 12:
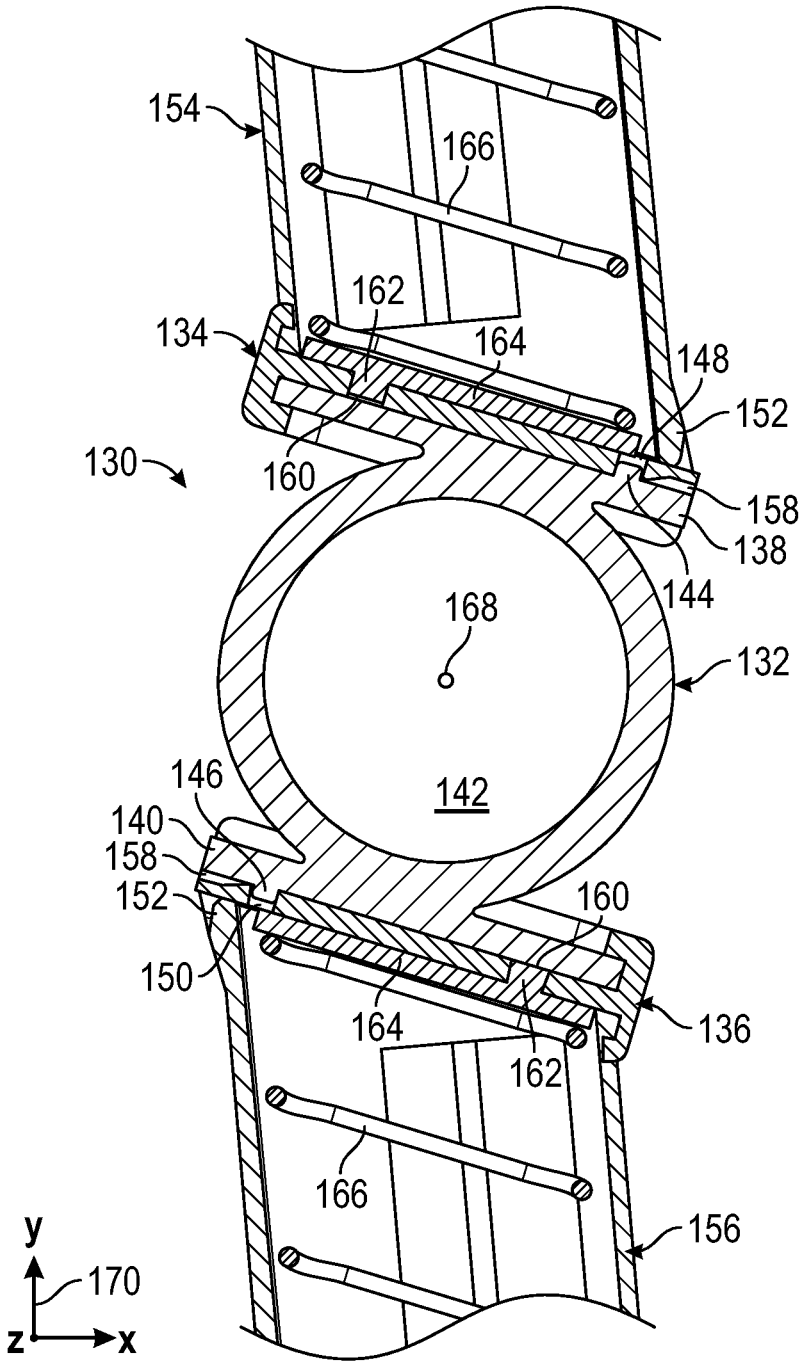

FIGS. 11 and 12 are side and cross-sectional views, respectively, of a quick change magazine coupler 130 similar to example magazine coupler 20 shown in FIGS. 1-10, but here fabricated as a non-articulating structure, as illustrated in accordance with a further example embodiment of the present disclosure. As was previously the case, quick change magazine 130 includes a central coupler body 132, a first slotted adapter piece 134 (FIG. 12), and a second slotted adapter piece 136 (FIG. 12). Slotted adapter pieces 134, 136 attach to opposing platform regions or flanges 138, 140 of coupler body 132, which are again located on opposing sides of a central opening or finger aperture 142 extending through coupler body 132. In the instant example, coupler body flanges 138, 140 both assume the form of slide-lock flanges analogous to slide-lock flange 58 described above in connection with FIGS. 1-7. Accordingly, slide-lock flange 138, 140 include small cylindrical protuberances or slide-lock buttons 144, 146, which project outwardly away from finger aperture 142. As shown in FIG. 12, slide-lock buttons 144, 146 are received in aligning apertures 148, 150 provided through slotted adapter pieces 134, 136, respectively, when magazine coupler 130 is assembled. Again, slotted adapter pieces 134, 136 are each fabricated to possess a dual-sided slotted design. More particularly, slotted adapter pieces 134, 136 are each produced to include a first slotted face, which inserts onto the corresponding slide-lock flanges 138, 140; and a second, opposing slotted face, which inserts onto the lower end portion 152 of a firearm magazine 154, 156, respectively. Each slotted adapter piece 134, 136 is also produced to include a channel 158 forming a gap with the corresponding slide-lock flange 138, 140 to allow the insertion of a tool to allow the removal of slotted adapter pieces 134, 136 from coupler body 132 in a manner analogous to that previously discussed in connection with slotted adapter piece 38 of magazine coupler 20.

Slotted adapter pieces 134, 136 are further fabricated to include spring-release button apertures 160. When firearm magazines 154, 156 are joined to quick change magazine coupler 130, spring-release buttons 162 project from corresponding spring-release plates 164 contained in the coupled firearm magazines 154, 156. In a manner similar to that previously described, spring-release plates 164 are urged against slotted adapter pieces 134, 136 by the expansive force of magazine springs 166, such as rectangular wireform springs, which are contained in firearm magazines 154, 156. Spring-release buttons 162 are captured within spring-release button apertures 160 to prevent the sliding disengagement of firearm magazines 154, 156 from slotted adapter pieces 134, 136 absent intentional user removal of magazines 154, 156. More specifically, and as generally described above in connection with slotted adapter piece 38 of quick change magazine coupler 20, a user or firearm operator can detach either of firearm magazines 154, 156 from the corresponding slotted adapter pieces 134, 136 by initially removing the appropriate slotted adapter piece 134, 136 from coupler body 132 utilizing the flat edge of a tool, such as a coin or a flathead screwdriver, inserted into the corresponding gap or channel 158. Removal of the selected slotted adapter piece 134, 136 from coupler body 132 reveals the slotted underside of the newly-removed adapter piece 134, 136 to provide physical access to the applicable spring-release button 162. The newly-revealed spring-release button 162 can then be depressed by the user utilizing a suitable tool to allow the sliding disengagement of the firearm magazine 154, 156 from the corresponding slotted adapter piece 134, 136.

As magazine coupler 130 lacks an articulating hinge joint between the coupler body 132 and either of slotted adapter piece 134, 136, quick change magazine coupler 130 cannot transition between a deployed state and a folded, stowable state in the same manner as does magazine coupler 20 described above in connection with FIGS. 1-10. Quick change magazine coupler 130 may thus be considered to remain in a deployed (active use) state at all times. This notwithstanding, quick change magazine coupler 130 permits a user to quickly interchange firearm magazines 154, 156 utilizing an intuitive, readily-performed spinning motion or action substantially identical to that described above in connection with quick change magazine coupler 20. To facilitate this function, the annular interior wall of coupler body 132 may be imparted with a substantially smooth, stepless topology and a substantially circular geometry, as viewed along the centerline of finger aperture 142 (represented in FIG. 12 by marker 168 and extending parallel to the Y-axis of coordinate legend 170). Additionally, when quick change magazine coupler 130 resides in a deployed state (which, in the example of FIGS. 11 and 12, is the exclusive state of magazine coupler 130), and when firearm magazines 154, 156 are attached to magazine coupler 130 as shown, slotted adapter pieces 134, 136 position firearm magazines 154, 156 in a first and second magazine orientations, respectively, which are rotated by approximately 180° about finger aperture centerline 168. Consequently, a user can rapidly spin magazine coupler 130 and coupled firearm magazines 154, 156 by about 180° when at least one finger of the user is inserted through finger aperture 142 to determine whether firearm magazine 154 is in a forward-facing, upright orientation for insertion into the magazine well of a non-illustrated firearm.

CONCLUSION

There has thus been provided embodiments of a quick change magazine coupler, which enables rapid interchange of firearm magazines in an intuitive, ergonomic manner; specifically, through a unique, spinning action readily performed by a user utilizing a single hand. This unique aspect of the quick change magazine coupler enables users to perform magazine interchanges in an efficient manner, even under adverse use case scenarios in which visual contact with the magazine coupler is limited or non-existent Embodiments of the quick change magazine coupler include magazine attachment interfaces, such as slotted adapter pieces, which securely attach firearm magazines to the magazine coupler in a structurally-robust, secure manner. Further, in certain embodiments, at least one of the magazine attachment interfaces may be joined to the coupler body in an articulating manner allow the magazine coupler to transition between a deployed state for usage and a folded, stowable state for ready storage. In such implementations, a latch mechanism may further be provided to lock or secure the magazine coupler in the stowable state until the latch mechanism is disengaged by a user. In other instances, the quick change magazine coupler may lack an articulating magazine attachment interface. In either instance, embodiments of the quick change magazine coupler are readily amenable to cost-effective manufacture and can be adapted for compatibility with a wide range of firearm magazines.

In embodiments, the magazine coupler includes a coupler body, a first magazine attachment interface and a second magazine attachment interface. The first magazine attachment interface is coupled to (e.g., joined to or integrally formed with) the coupler body and configured to removably attach or mount a lower end portion of the first firearm magazine to the coupler body. Similarly, the second magazine attachment interface is coupled to (e.g., joined to or integrally formed with) the coupler body and configured to removably attach or mount a lower end portion of the second firearm magazine to the coupler body. The magazine coupler further includes a finger aperture, such as a relatively large central opening, extending through the coupler body. The finger aperture is sized and shaped to enable a user to spin the magazine coupler about a finger of the user (one user finger or multiple user fingers) when inserted through the finger aperture to vary which of the first firearm magazine and the second firearm magazine resides in an upright orientation for insertion into a well of a firearm when the magazine coupler resides in a deployed state. Further, in at least some embodiments, the finger aperture is located between the first magazine attachment interface and the second magazine attachment interface when the magazine coupler resides in the deployed state. Additionally or alternatively, when the magazine coupler resides in a deployed state, (i) the first magazine attachment interface positions the first firearm magazine in a first magazine orientation, and (ii) the second magazine attachment interface positions the second firearm magazine in a second magazine orientation, which is rotated by approximately 180 degrees about a centerline of the finger aperture relative to the first magazine orientation. The finger aperture may further be bound by an inner annular wall of the coupler body, which may possess a substantially circular geometry, as viewed along the finger aperture centerline, and may have a substantially smooth or stepless topology.

In further embodiments, the magazine coupler may include a coupler body, a first magazine attachment interface hingedly coupled to the coupler body, and a second magazine attachment interface joined to the coupler body. The first magazine attachment interface may be configured to removably mount a lower end portion of the first firearm magazine to the coupler body; and, further, may be rotatable relative to the coupler body about a hinge line (rotational axis) to transition the magazine coupler between a deployed state and a stowable state. Comparatively, the second magazine attachment interface may be configured to removably mount a lower end portion of the second firearm magazine to the coupler body at a location substantially opposite the first firearm magazine when the magazine coupler resides in the deployed state or positioning. In certain implementation, the first magazine attachment interface comprises (includes or assumes the form of) a first slotted adapter piece configured to removably attach to the lower end portion of the first firearm magazine after removal of a baseplate therefrom. Similarly, in embodiments, the second magazine attachment interface may include or assume the form of a second slotted adapter piece configured to removably attach to a lower end portion of the second firearm magazine and removably joined to the coupler body in a non-articulating manner. In still other embodiments, a finger aperture may extend through the coupler body at a location between the first magazine attachment interface and the second magazine attachment interface when the magazine coupler resides in the deployed state, with the finger aperture sized and shaped to enable a user to spin the magazine coupler about a finger of the user when inserted through the finger aperture.

Terms such as "comprise," "include," "have," and variations thereof are utilized herein to denote non-exclusive inclusions. Such terms may thus be utilized in describing processes, articles, apparatuses, and the like that include one or more named steps or elements, but may further include additional unnamed steps or elements. The phrase "at least one" referencing a named group or listing should be understood to include any single member of the named group or any combination of members of the named group or listing. For example, "at least one of A or B" (A and B denoting different named elements, steps, structures, devices, or features) should be understood to mean only A (and not B) is present, only B (and not A) is present, or both A and B are present. The phrase "one or more of" should be interpreted in the same manner. Lastly, the usage of indefinite articles, such as "a" or "an," encompass one or more than one instance of a named element, step, structure, device, or feature. Accordingly, description of a particular apparatus, method, structure, or the like as including "a" named feature, step, device, or the like does not preclude the possibility that the particular apparatus, method, or structure may include multiple instances of the named feature, step, or device.

While at least one example embodiment has been presented in the foregoing Detailed Description, it should be appreciated that a vast number of variations exist. It should also be appreciated that the example embodiment or example embodiments are only examples, and are not intended to limit the scope, applicability, or configuration of the invention in any way. Rather, the foregoing Detailed Description will provide those skilled in the art with a convenient road map for implementing an example embodiment of the invention. Various changes may be made in the function and arrangement of elements described in an example embodiment without departing from the scope of the invention as set-forth in the appended Claims.

What is claimed is:

1. A magazine coupler utilized to attach a first firearm magazine to a second firearm magazine, the magazine coupler comprising:

a coupler body;

a first magazine attachment interface hingedly coupled to the coupler body and configured to removably mount a lower end portion of the first firearm magazine to the coupler body, the first magazine attachment interface rotatable relative to the coupler body about a hinge line to transition the magazine coupler between a deployed state and a stowable state; and a second magazine attachment interface joined to the coupler body and configured to removably mount a lower end portion of the second firearm magazine to the coupler body at a location substantially opposite the first firearm magazine when the magazine coupler resides in the deployed state.

2. The magazine coupler of claim 1, wherein the first magazine attachment interface comprises a first slotted adapter piece configured to removably attach to the lower end portion of the first firearm magazine after removal of a baseplate therefrom.

3. The magazine coupler of claim 2, wherein the second magazine attachment interface comprises a second slotted adapter piece removably joined to the coupler body in a non-articulating manner.

4. The magazine coupler of claim 1, further comprising a finger aperture extending through the coupler body at a location between the first magazine attachment interface and the second magazine attachment interface when the magazine coupler resides in the deployed state, the finger aperture sized and shaped to enable a user to spin the magazine coupler about a finger of the user when inserted through the finger aperture.

5. The magazine coupler of claim 1, further comprising a latch mechanism configured to maintain the magazine coupler in the deployed state until the latch mechanism is disengaged by the user.

6. A magazine coupler utilized to attach a first firearm magazine to a second firearm magazine, the magazine coupler comprising:

a coupler body including a first coupler body flange;

a first magazine attachment interface coupled to the coupler body and configured to removably mount a lower end portion of the first firearm magazine to the coupler body;

a second magazine attachment interface coupled to the coupler body and configured to removably mount a lower end portion of the second firearm magazine to the coupler body; and a finger aperture extending through the coupler body, the finger aperture sized and shaped to enable a user to spin the magazine coupler about a finger of the user when inserted through the finger aperture to vary which of the first firearm magazine and the second firearm magazine resides in an upright orientation for insertion into a well of a firearm when the magazine coupler resides in a deployed state;

wherein the finger aperture extends through the coupler body along a finger aperture centerline; and wherein the first magazine attachment interface is hingedly joined to the first coupler body flange for rotation about a hinge line extending substantially parallel to the finger aperture centerline.

7. The magazine coupler of claim 6, wherein the finger aperture is located between the first magazine attachment interface and the second magazine attachment interface when the magazine coupler resides in the deployed state.

8. The magazine coupler of claim 6, wherein the finger aperture extends through the coupler body along a finger aperture centerline; and wherein, when the magazine coupler resides in a deployed state, the first magazine attachment interface positions the first firearm magazine in a first magazine orientation, while the second magazine attachment interface positions the second firearm magazine in a second magazine orientation; and wherein the second magazine orientation which is rotated by approximately 180 degrees about the finger aperture centerline relative to the first magazine orientation.

9. The magazine coupler of claim 8, wherein the finger aperture is bound by an inner annular wall of the coupler body having a substantially circular geometry, as viewed along the finger aperture centerline.

10. The magazine coupler of claim 6, wherein the finger aperture has a diameter between 16 and 50 millimeters.

11. The magazine coupler of claim 6, wherein the first coupler body flange is located on a first side of the finger aperture and is joined to the first magazine attachment interface; and wherein the coupler body further comprises a second coupler body flange located on a second, opposing side of the finger aperture and to which the second magazine attachment interface is joined.

12. The magazine coupler of claim 11, wherein the first magazine attachment interface comprises a first slotted adapter piece joined to the first coupler body flange, the first slotted adapter piece configured to matingly engage the lower end portion of the first firearm magazine after removal of a baseplate therefrom.

13. The magazine coupler of claim 12, wherein the first firearm magazine comprises magazine tabs extending laterally outward from the lower end portion of the first firearm magazine; and wherein the first slotted adapter piece comprises:

a retention slot having a slot floor and an open end into which the lower end portion of the first firearm magazine inserts; and side rails partially enclosing the retention slot and configured to slidably engage the magazine tabs to prevent disengagement of the first firearm magazine in a direction away from the slot floor.

14. The magazine coupler of claim 6, wherein the magazine coupler is movable from the deployed state into a stowable state by rotation of the first slotted adapter piece relative to the coupler body about the hinge line.

15. The magazine coupler of claim 14, wherein the first firearm magazine and the second firearm magazine are positioned in an approximate side-by-side relationship when attached to the magazine coupler, while in the stowable state.

16. The magazine coupler of claim 6, further comprising a latch mechanism configured to maintain the magazine coupler in the deployed state until the latch mechanism is disengaged by the user.

17. The magazine coupler of claim 16, wherein first slotted adapter piece comprises a latch feature;

wherein the coupler body comprises a catch feature projecting away from the finger aperture; and wherein the catch feature cooperates with the latch feature to yield the latch mechanism.

18. The magazine coupler of claim 17, wherein the coupler body comprises:

a central annular portion through which the finger aperture is formed; and a fingerguard feature projecting from central annular portion in a peripherally-outward direction at a location adjacent the catch feature.

19. The magazine coupler of claim 12, wherein the second magazine attachment interface comprises a second slotted adapter piece slidably engaged onto the second coupler body flange.

20. The magazine coupler of claim 19, wherein the second slotted adapter piece comprises:

a first slotted face for slidably engaging the second coupler body flange; and a second slotted face opposite the first slotted face for slidably attaching to the lower end portion of the second firearm magazine.

* * * * *